US009941618B2

(12) United States Patent
Chan

(10) Patent No.: US 9,941,618 B2
(45) Date of Patent: Apr. 10, 2018

(54) ELECTRICAL CONNECTOR

(71) Applicant: Kung Chan, Hong Kong (HK)

(72) Inventor: Kung Chan, Hong Kong (HK)

( * ) Notice: Subject to any disclaimer, the term of this patent is extended or adjusted under 35 U.S.C. 154(b) by 0 days.

(21) Appl. No.: 15/435,497

(22) Filed: Feb. 17, 2017

(65) Prior Publication Data

US 2017/0244190 A1 Aug. 24, 2017

Related U.S. Application Data

(60) Provisional application No. 62/297,950, filed on Feb. 22, 2016.

(51) Int. Cl.
*H01R 13/424* (2006.01)
*H01R 13/506* (2006.01)
*H01R 13/02* (2006.01)

(52) U.S. Cl.
CPC ..... *H01R 13/424* (2013.01); *H01R 13/025* (2013.01); *H01R 13/506* (2013.01)

(58) Field of Classification Search
CPC ... H01R 13/424; H01R 13/025; H01R 13/506
USPC ..... 439/701
See application file for complete search history.

(56) References Cited

U.S. PATENT DOCUMENTS 4,438,292 A * 3/1984 Woodall ..... G01V 1/181 174/549
4,720,267 A * 1/1988 De Jong ..... H01R 13/502 439/279
5,178,159 A * 1/1993 Christian ..... A61B 8/06 600/434
5,240,437 A * 8/1993 Christian ..... A61B 8/06 439/13
6,179,627 B1 * 1/2001 Daly ..... H01R 13/6658 439/354
6,203,333 B1 * 3/2001 Medina ..... H01R 13/6658 439/465
7,520,763 B1 * 4/2009 Buse ..... H01R 25/142 439/121
7,641,503 B1 * 1/2010 van der Horn .... H01R 13/5812 439/457
2002/0148078 A1 * 10/2002 Salentine ..... A45F 5/004 24/115 F
2002/0173191 A1 * 11/2002 I-Tse ..... H01R 13/5812 439/329
2006/0211293 A1 * 9/2006 Li ..... H01R 13/5816 439/455

(Continued)

*Primary Examiner* — Alexander Gilman
(74) *Attorney, Agent, or Firm* — Spruson & Ferguson (HK)

(57) ABSTRACT

Having an advantage in user convenience, an electrical connector for connecting with an electrical cable under a do-it-yourself scenario is provided, where the cable has a knot at a cable end. The connector comprises a connector body and a cover. The connector body has an internal space for housing the knot, an opening for allowing the cable end to access the internal space, and an outlet for allowing the cable to run from the internal space to outside the connector body. The cover has a top plate for covering the opening. In particular, the cover includes two wings protruded from the top plate collectively for claiming the knot to secure the knot inside the internal space. A separation of the two wings is advantageously selected to be 2 times to 3 times of a cross-sectional width of the outlet for producing a clamping effect on the knot.

18 Claims, 9 Drawing Sheets

(56) References Cited

U.S. PATENT DOCUMENTS

2007/0110385 A1* 5/2007 Shakeri ..... H01R 13/5845
385/138
2007/0217642 A1* 9/2007 Wickstrom ..... H04R 1/1016
381/380

* cited by examiner

ELECTRICAL CONNECTOR

CROSS-REFERENCE TO RELATED APPLICATIONS

This application claims the benefit of U.S. Provisional Patent Application No. 62/297,950, filed on Feb. 22, 2016, the disclosure of which is incorporated by reference herein in its entirety.

FIELD OF THE INVENTION

The present invention generally relates to an electrical connector. In particular, the present invention relates to such electrical connector for enabling a general user to easily connect a cable to the connector to make up a hand-made plug.

BACKGROUND

In the field of consumer electronics, there is a rising trend that an end user (namely, a consumer) reworks, modifies or combines consumer-electronic products in order to "invent" new personalized devices for the end user himself or herself. Such act of invention is often referred to as do-it-yourself (DIY). In addition, the inventor believes that this breaking and fixing activity is a piece of great learning experience for the young generation.

Consider an example that the end user wishes to add wireless connectivity to a stylish, fashionable headset originally configured to directly plug into an audio output of a smartphone, thereby getting a DIY headset. The headset has an electrical cable for transmitting an audio signal from the smartphone to the two earpieces of the headset. The end user may rework the headset by first cutting out an end of the cable, causing the cable to reveal the electrical wires therein. Then the exposed end of the cable is mounted to an electrical connector to form a hand-made plug that can be plugged into a Bluetooth transceiver for providing wireless connectivity to the headset. The electrical connector is a mechanical assembly or an electro-mechanical device for interfacing the cable and the Bluetooth transceiver.

Most existing electrical connectors are specifically designed and highly adapted for use by machine mounting of cables in manufacturing lines, and are not adapted for a DIY scenario. Thus, the end user often finds difficulty in mounting an exposed cable end to an existing electrical connector. There is a need in the art to have an electrical connector specifically configured to provide user convenience when a human user mounts a cable thereto by hand.

SUMMARY OF THE INVENTION

An aspect of the present invention is to provide an electrical connector for connecting with an electrical cable to form a plug or a socket. The electrical cable has a pre-defined cable width and a knotted cable end. The knotted cable end has a knot and a plurality of bare wire ends. The electrical connector comprises a connector body and a cover connectable together. The connector body is used for housing the knotted cable end and allowing the bare wire ends to be exposed outside the connector body to form electrical contacts for the plug or the socket. The cover is configured to be positioned on and fixed to the connector body.

The connector body comprises a frame forming a bulk of the connector body. The frame has an internal space formed therein for housing at least the knot. The connector body further comprises an opening for allowing the knotted cable end to access the internal space, and optionally an outlet for allowing the electrical cable to run from the internal space to outside the connector body when the opening is closed by positioning the cover on the connector body.

The cover comprises a top plate for covering the opening of the connector body, and a first wing and a second wing both protruded from the top plate. The first wing and the second wings are collectively used for clamping the knot so as to secure the knot inside the internal space when the cover is positioned on and fixed to the connector body.

Preferably, the first wing and the second wing are arranged to be substantially parallel. It is also preferable that the first wing and the second wing are separated with a wing separation selected to be 2 times to 3 times of a cross-sectional width of the outlet for producing a clamping effect on the knot.

The connector body further comprises a plurality of slots for allowing the plurality of bare wire ends to be secured thereto.

In one option, the cover further comprises a front plate for covering the slots of the connector body when the cover is positioned on and fixed to the connector body. In another option, the cover further comprises a plurality of keys protruded from the top plate and the front plate, the keys being shaped and dimensioned to fit to the slots for securing the bare wire ends in the slots when the cover is positioned on and fixed to the connector body.

The plurality of slots may be located on a front side of the connector body, or may be distributed on a front side and at least one of lateral sides of the connector body.

Preferably, the cover further includes a first hook and a second hook protruded from the first wing and the second wing, respectively. The first hook and the second hook are used together for locking the cover to the connector body when the cover is positioned onto the connector body. The connector body further includes a first receptacle and a second receptacle located on a first lateral side of the connector body and a second lateral side opposite to the first lateral side, respectively. The first receptacle and the second receptacle are used for receiving the first hook and the second hook, respectively, and locking thereto.

Other aspects of the present invention are disclosed as illustrated by the embodiments hereinafter.

DETAILED DESCRIPTION

An aspect of the present invention is to provide an electrical connector for connecting with an electrical cable to form a plug/socket connectable to a corresponding socket/plug for making electrical connection. The disclosed electrical connector provides a particular advantage in user convenience in that a general user can easily make up a hand-made plug/socket with an electrical cable in making a personalized consumer-electronic device.

The inventor has made the following observations that have led to the present invention.

Figure 1:
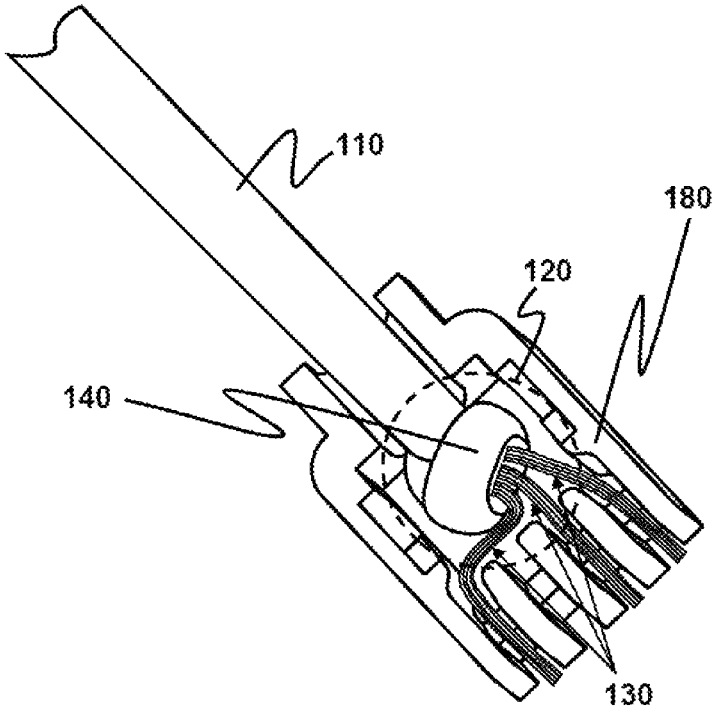
FIG. 1 is an example depicting an electrical having a cable end positioned in inside a frame to form an electrical connector.

FIG. 1 depicts an example of an electrical cable 110 having a cable end 120. The cable end 120 has a plurality of exposed electrical wires 130, and is positioned inside a frame 180 for forming an electrical connector when the cable end 120 is mounted to the frame 180. The exposed wires 130 are also known as bare wire ends. The inventor has observed that if the cable 110 is knotted with an overhead knot 140, the cable end 120 can be secured inside the frame 180. The overhead knot 140, which is realized as a simple noose, acts as a stopper to prevent the cable end 120 from being pulled off from the frame 180. It follows that if a person inadvertently pulls the cable 110 in a direction away from the frame 180, the chance that the cable end 120 is accidentally detached from the frame 180, or that the exposed electrical wires 130 are loosened, is much reduced. The cable end 120, which has the overhead knot 140, is an exemplary example of a knotted cable end.

Figure 2:
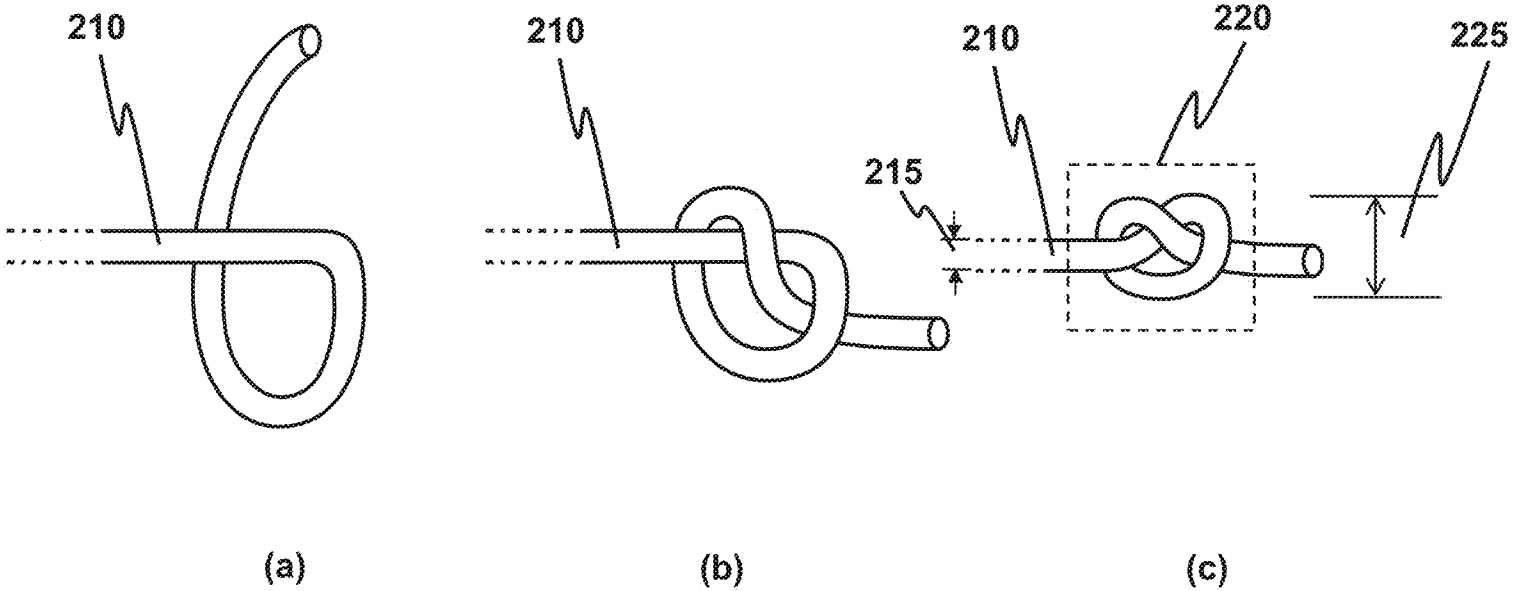
FIG. 2 depicts the steps to obtain an overhead knot from a cable.

FIG. 2 pictorially illustrates how to obtain an overhead knot 220 from a cable 210 through three steps (a) to (c). The overhead knot 220 is a simple noose.

Based on the aforementioned observations, the present invention is developed to give an electrical connector configured to accommodate a cable with a knotted cable end while providing user convenience for an end user to put the cable into the electrical connector in a DIY scenario.

Figure 3:
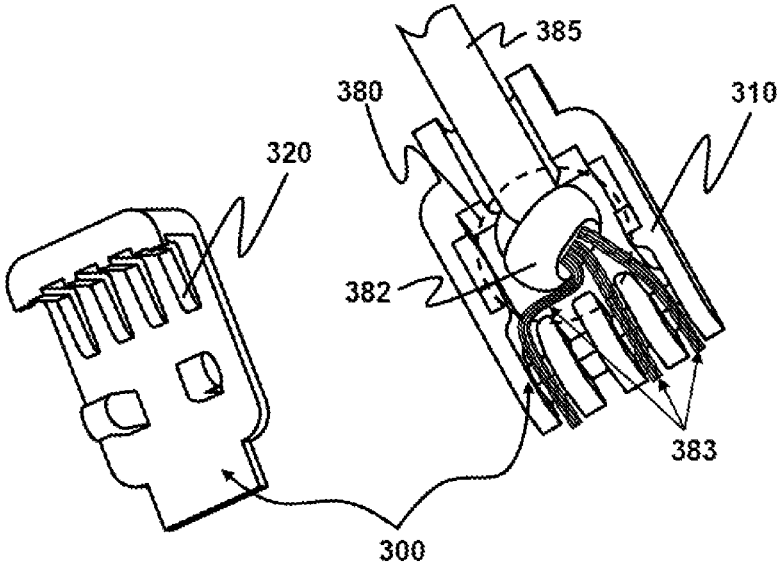
FIG. 3 depicts an exploded view of an electrical connector having a connector body and a cover in accordance with an exemplary embodiment of the present invention, where the electrical connector is shown with an electrical cable mounted thereto.

The electrical connector provided herein is explained with an aid of FIG. 3, which depicts an exploded view of an electrical connector 300 according to an exemplary embodiment of the present invention, the electrical connector 300 being mounted with an electrical cable 385. In particular, the electrical connector 300 is configured to adapt to the electrical cable 385 having a pre-defined cable width. As used herein in the specification and appended claims, "a cable width" of an electrical cable is the greatest length obtainable between any two points on a boundary of a cross-section of the electrical cable. Generally, a commonly-found electrical cable is a flat cable or a cable having a circular cross-section. In the case that the electrical cable has a circular cross-section, the cable width is a cable diameter. Although the electrical cable 385 having the pre-defined cable width is considered, the role of this electrical cable 385 in the consideration here is for designing the electrical connector 300. The electrical connector 300 as disclosed herein in the present invention is in practice usable for mounting to any electrical cable with a certain cable width close to the aforementioned pre-defined cable width.

The electrical connector 300 comprises a connector body 310 and a cover 320 connectable together. The connector body 310 is configured to house a knotted cable end 380 of the electrical cable 385. The knotted cable end 380 has a knot 382 and a plurality of bare wire ends 383. After the knotted cable end 380 is put into the connector body 310, the cover 320 is positioned on and fixed to the connector body 310 to make up an enclosed space to hold the knotted cable end 380 therein. The connector body 310 is further configured to allow the bare wire ends 383 to be exposed outside the connector body 310 to form electrical contacts 313 for the plug or the socket that is formed after the cover 320 is fixed to the connector body 310.

As seen from FIG. 2, the knot 220 has a cross-sectional width 225 of around 3 times of a diameter 215 of the cable 210. In practice, there may be a shrinking on the width of the knot 220 as a user pulls the cable 210 in forming the knot 220. Refer to FIG. 3. In the design of the electrical connector 300, it is assumed that the knot 382 has a cross-sectional width of 2.5 to 3 times of the diameter of the electrical cable 385.

Figure 4:
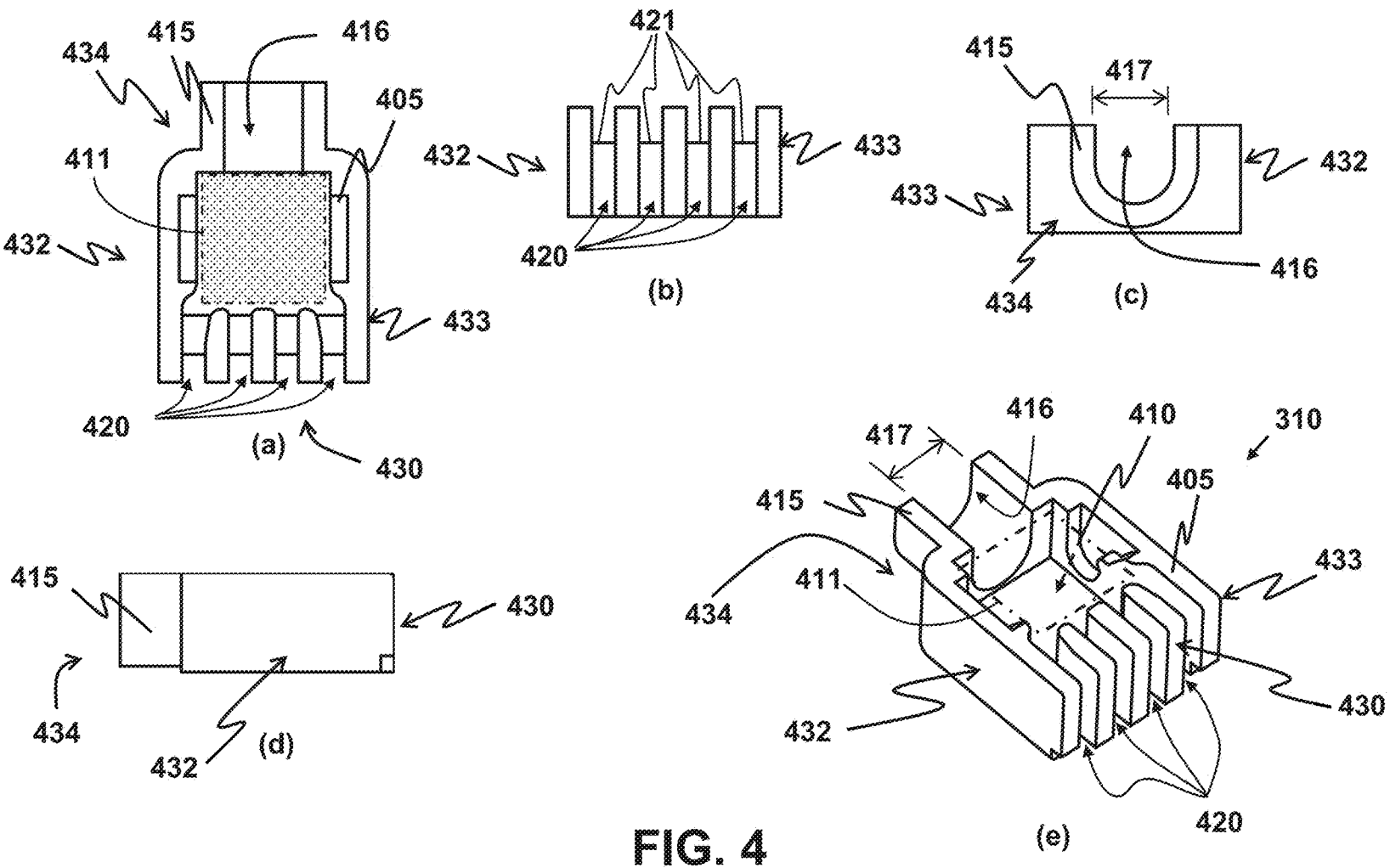
FIG. 4 depicts different views of the connector body according to one embodiment of the present invention, where the different views are (a) a top view, (b) a front view, (c) a back view, (d) a side view, and (e) a perspective view.

FIG. 4 depicts (a) a top view, (b) a front view, (c) a back view, (d) a side view, and (e) a perspective view, of the connector body 310. The connector body 310 comprises: a frame 405 forming a bulk of the connector body 310; an internal space 410 in the frame 405 for housing at least the knot 382 of the knotted cable end 380; an opening 411 for allowing the knotted cable end 380 to access the internal space 410; and a plurality of slots 420 for allowing the plurality of bare wire ends 383 to be secured thereto. Usually, the connector body 310 further comprises an outlet 416 for allowing the electrical cable 385 to run from the internal space 410 to outside the connector body 310 when the cover 320 is positioned onto the connector body 310. However, it is also possible that the cover 320 may be implemented with an outlet to perform a similar function instead of including the outlet 416 in the connector body 310.

The internal space 410 is required to house at least the knot 382. As it is considered that the knot 382 has the cross-sectional width at most 3 times of the cable width, the internal space 410 is designed to have a length, measured in a direction perpendicular to a running direction of the electrical cable 385 at the knotted cable end 380 when the knot 382 is positioned inside the internal space 410 and the electrical cable 385 runs through the outlet 416, of at least 3 times of the cable width.

The outlet 416 is realized as a hole on the frame 405, and allows the electrical cable 385 to pass through. Preferably the outlet 416 has a size just fitting the electrical cable 385 in order to produce a clamping effect on the electrical cable 385. In general, the outlet 416 may be sized such that the cable width is 0.8 to 1 times of a cross-sectional width 417 of the outlet 416. It is also preferable that the outlet 416 is partially surrounded by a U-shape plate 415 protruded from the frame 405 for supporting and guiding the electrical cable 385.

The bare wire ends 383 are respectively accommodated in the slots 420. After the cover 320 is secured onto the connector body 310 to form a hand-made plug, the bare wire ends 383 are fixed to the slots 420 and become electrical contact points of the hand-made plug. Any one of the slots 420 may be located on a front side 430, a first lateral side 432, or a second lateral side 433, of the frame 405. The front side 430 is opposite to a back side 434 having the outlet 416. The first lateral side 432 and the second lateral side 433 are adjacent to the back side 434. In one option, all the slots 420 are located on the front side 430. In another option, the slots 420 are distributed over the front side 430, the first lateral side 432 and the second lateral side 433. Other options on the distribution of the slots 420 are possible.

Figure 5:
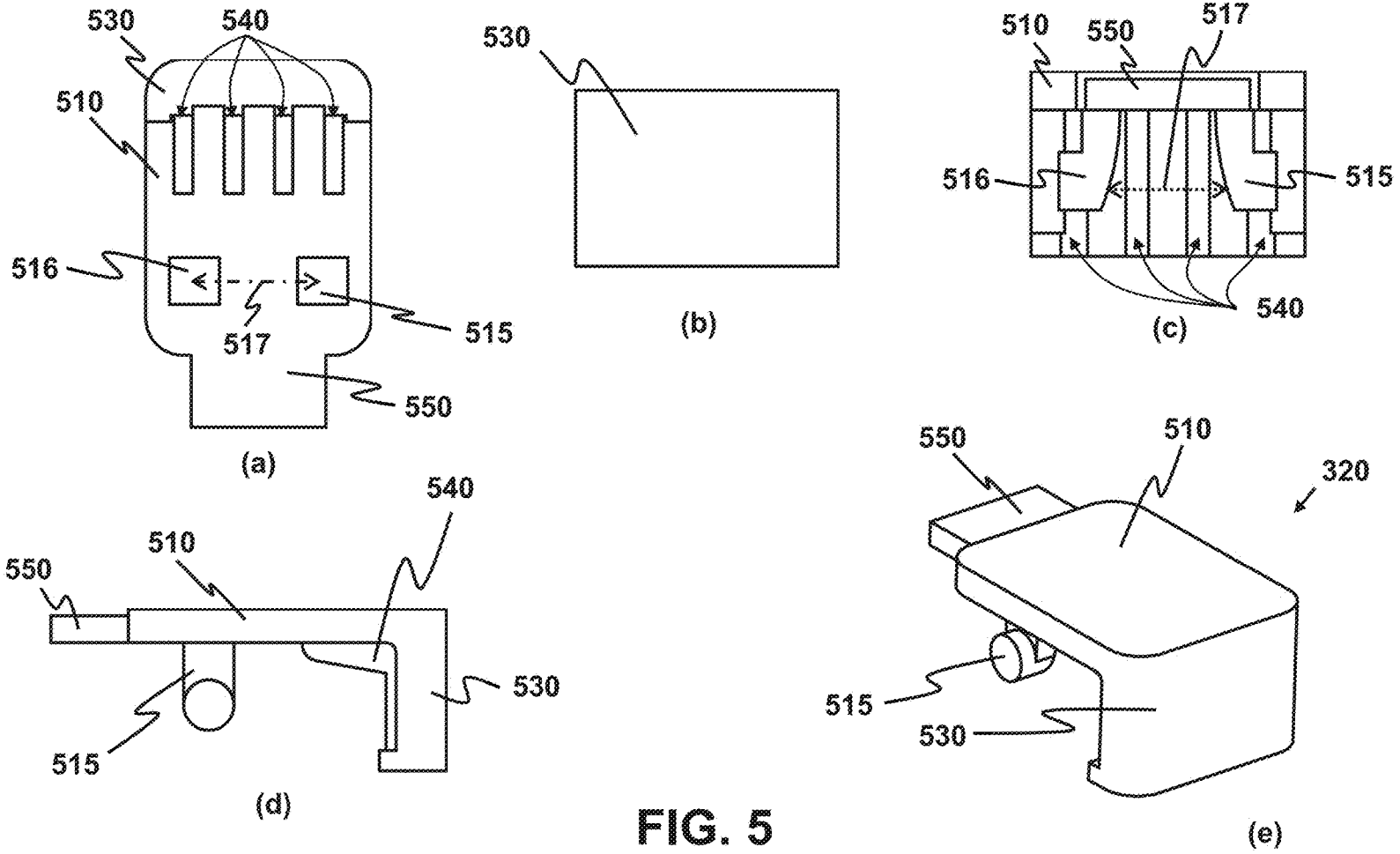
FIG. 5 depicts different views of the cover according to one embodiment of the present invention, where the different views are (a) a bottom view, (b) a front view, (c) a back view, (d) a side view, and (e) a perspective view.

FIG. 5 depicts (a) a bottom view, (b) a front view, (c) a back view, (d) a side view, and (e) a perspective view, of the cover 320.

The cover 320 comprises a top plate 510 for covering the opening 411 of the connector body 310 so as to form the enclosed space to hold the knotted cable end 380 inside the electrical connector 300. Advantageously, the cover 320 further comprises a first wing 515 and a second wing 516 collectively for clamping the knot 382 so as to secure the knot 382 inside the internal space 410 when the cover 320 is positioned on and fixed to the connector body 310. Both of the wings 515, 516 are protruded from the top plate 510 and are preferably arranged to be substantially parallel. If arranged to be substantially parallel, the two wings 515, 516 are separated with a wing separation 517, which is a distance measured between the first wing 515 and the second wing 516. Since the knot 382 is considered to have the cross-sectional width from 2.5 to 3 times of the cable width, and since the cable width is about 0.8 to 1 times of the cross-sectional width 417 of the outlet 416 as mentioned above, it follows that the wing separation 517 is preferably selected to be 2 times to 3 times of the cross-sectional width 417 of the outlet 416, preferably close to 2 times to more effectively exert a clamping effect on the knot 382.

Preferably, the cover 320 further comprises a front plate 530. The front plate 530 is for covering the slots 420 of the connector body 310, and is shaped and dimensioned such that when the cover 320 is fixed to the connector body 310, the bare wire ends 383 are exposed outside the electrical connector 300 to give a plurality of contact points for making electrical connection with any outside device that the electrical connector 300 (i.e. the hand-made plug) is plugged to. It is also preferable that the cover 320 further includes a plurality of keys 540 protruded from the top plate 510 and the front plate 530. The keys 540 are shaped and dimensioned to fit to the slots 420 so as to secure the bare wire ends 383 in the slots 420. Optionally, there is a closing plate 550 in the cover 320. The closing plate 550 is arranged to work with the U-shape plate 415 of the connector body 310 in order to close the U-shaped plate 415, enabling the electrical cable 385 to be fittingly accommodated therein when the electrical cable 385 is connected with the electrical connector 300.

Figure 6:
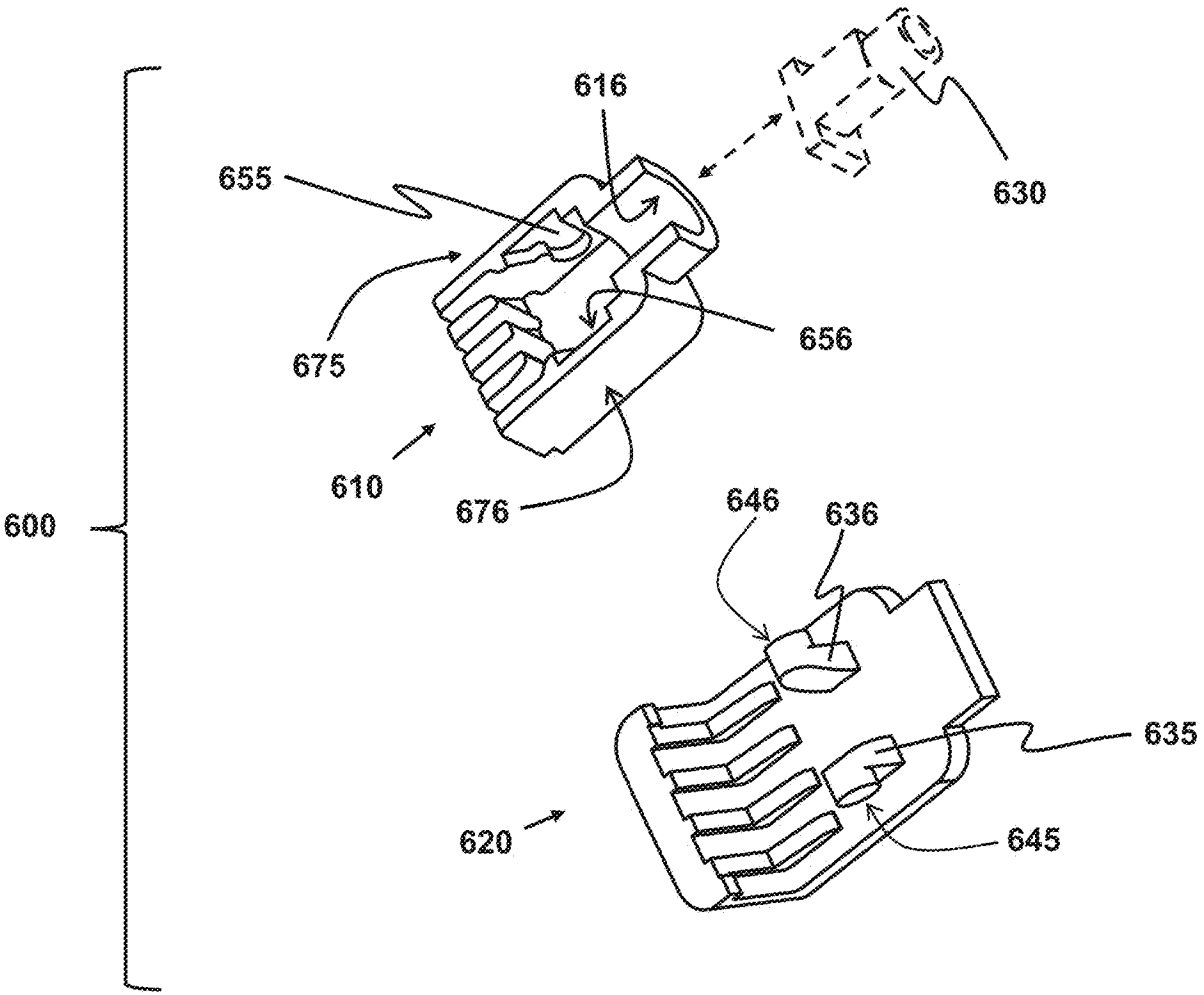
FIG. 6 depicts, in accordance with one embodiment of the present invention, an electrical connector having a locking mechanism for locking a connector body and a cover, where the locking mechanism is realized by having two wings in the cover to respectively lock with two receptacles in the connector body. It is also depicted in FIG. 6 that an optional cable holder for holding the electrical cable may also be included in the electrical connector.

In one embodiment of the present invention, the electrical connector 300 has a locking mechanism to lock the connector body 310 and the cover 320. FIG. 6 depicts an electrical connector 600 comprising a connector body 610 and a cover 620 according to this embodiment. The cover 620 has a first wing 635 and a second wing 636. In addition, the first wing 635 includes a first hook 645, and the second wing 636 includes a second hook 646. The first hook 645 and the second hook 646 are used together to lock the cover 620 to the connector body 610 when the cover 620 is positioned onto the connector body 610. The first hook 645 is received by and locked to a first receptacle 655, which is in a form of a groove recessed from a first lateral side 675 of the connector body 610. Similarly, the second hook 646 is received by and locked to a second receptacle 656. The second receptacle 656 is also formed as a groove recessed from a second lateral side 676 of the connector body 610.

Other options of the electrical connector 300 are elaborated in the following embodiments.

Figure 7:
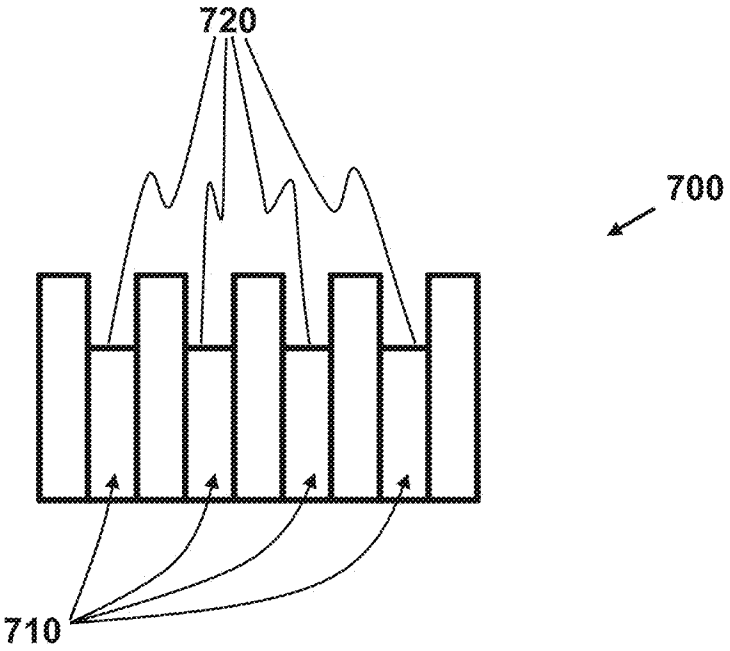
FIG. 7 depicts, in accordance with one embodiment of the present invention, a front-side view of a connector body, where plural slots of the connector body have turning edges, each having a U shape.

Refer to the subplot (b) of FIG. 4. The plurality of slots 420 has a plurality of turning edges 421 for allowing the bare wire ends 383 to be bent over there so as to enable the bare wire ends 383 to be accommodated in the slots 420. As shown in this subplot, each of the turning edges 421 is a substantially straight line. However, the present invention is not limited to substantially-straight turning edges. The turning edges 421 may be curved and of any shape. As one embodiment, FIG. 7 depicts a front-side view of a connector body 700 comprising a plurality of slots 710 having a plurality of turning edges 720, where each of the turning edges 720 has a U shape. Other shapes, such as a simple V shape and a V shape realized by two non-straight curves, are also possible.

Figure 8:
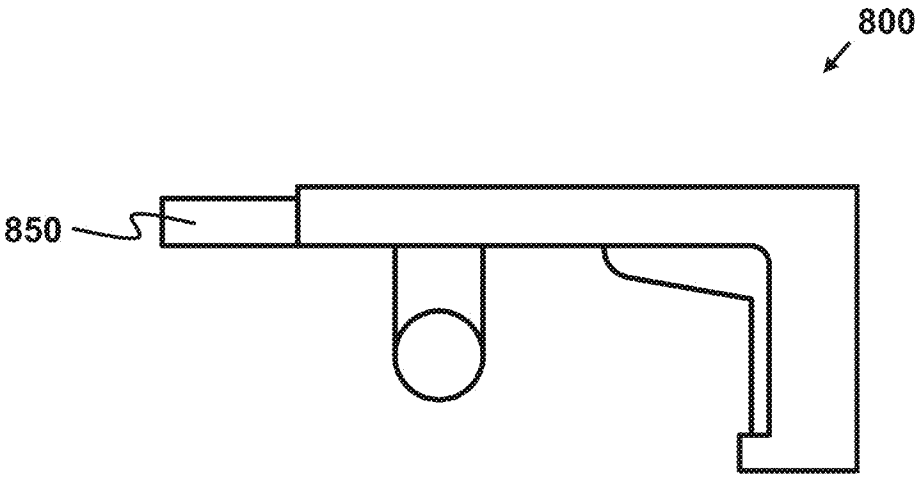
FIG. 8 depicts, according to one embodiment of the present invention, a side view of a cover, where the cover has a closing plate formed as an L-shaped solid.

Refer to the subplot (d) of FIG. 5. The closing plate 550 is formed and shaped as a rectangular slab. Other shapes of the closing plate 550 are possible. One alternative of a closing plate is shown in FIG. 8, which depicts a side view of a cover 800. The cover 800 has a closing plate 850 formed as an L-shaped solid.

Refer to FIG. 6 again. The electrical connector 600 may also include a cable holder 680 in a form of a hollow tube for holding the electrical cable therein. The cable holder 680 is configured to fit into an outlet 616 of the connector body 610, thereby allowing the electrical cable to run from insider to outside the connector body 610 through the cable holder 680. In this way, the cable holder 680 protects the electrical cable from possible scratching. The cable holder 680 is detachable from the connector body 610.

In one embodiment, the connector body 310 and the cover 320 are made of plastic.

Figure 9:
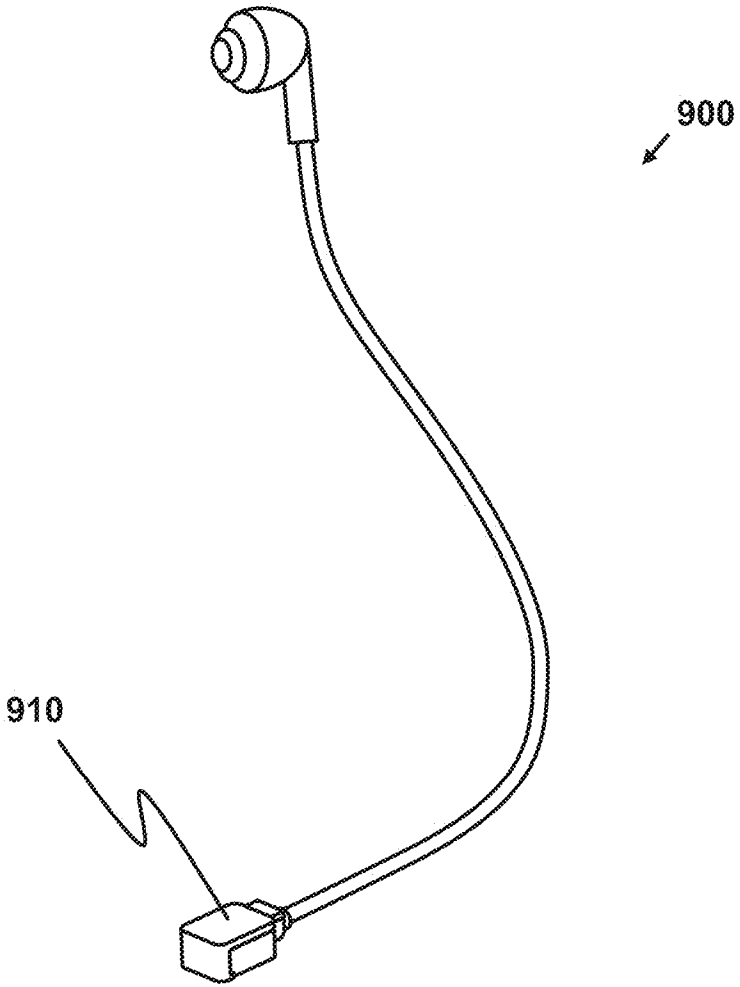
FIG. 9 provides an example of a personalized ear-phone having a hand-made plug formed by an embodiment of the electrical connector.

FIG. 9 depicts, as an example application of the present invention, a personalized ear-phone 900 having a hand-made plug 910 formed by an embodiment of the electrical connector as disclosed herein.

Although the invention has been described in embodiments predominantly based on a male-end connector, the present invention is not limited only to the connector that is of a male type. It is apparent to an ordinary person skilled in the art that the embodiments described above may be modified to give a female-type connector. The present invention includes the female-type connector as one embodiment.

The present invention may be embodied in other specific forms without departing from the spirit or essential characteristics thereof. The present embodiment is therefore to be considered in all respects as illustrative and not restrictive. The scope of the invention is indicated by the appended claims rather than by the foregoing description, and all changes that come within the meaning and range of equivalency of the claims are therefore intended to be embraced therein.

What is claimed is:

1. An electrical connector for connecting with an electrical cable to form a plug or a socket, the electrical cable having a pre-defined cable width and a knotted cable end, the knotted cable end having a knot and a plurality of bare wire ends, the electrical connector comprising a connector body and a cover connectable together, the connector body being used for housing the knotted cable end and allowing the bare wire ends to be exposed outside the connector body to form electrical contacts for the plug or the socket, the cover being configured to be positioned on and fixed to the connector body, the connector body comprising:

a frame forming a bulk of the connector body, the frame having an internal space formed therein for housing at least the knot; and an opening for allowing the knotted cable end to access the internal space;

the cover comprising:

a top plate for covering the opening of the connector body; and a first wing and a second wing both protruded from the top plate, collectively for clamping the knot so as to secure the knot inside the internal space when the cover is positioned on and fixed to the connector body;

wherein the connector body further comprises a plurality of slots for allowing the plurality of bare wire ends to be secured thereto; and wherein the cover further comprises a front plate for covering the slots of the connector body when the cover is positioned on and fixed to the connector body.

2. The electrical connector of claim 1, wherein the first wing and the second wing are arranged to be substantially parallel.

3. The electrical connector of claim 2, wherein:

the connector body further comprises an outlet for allowing the electrical cable to run from the internal space to outside the connector body when the opening is closed by positioning the cover on the connector body; and the first wing and the second wing are separated with a wing separation selected to be 2 times to 3 times of a cross-sectional width of the outlet for producing a clamping effect on the knot.

4. The electrical connector of claim 1, wherein the cover further comprises a plurality of keys protruded from the top plate and the front plate, the keys being shaped and dimensioned to fit to the slots for securing the bare wire ends in the slots when the cover is positioned on and fixed to the connector body.

5. The electrical connector of claim 1, wherein the plurality of slots is located on a front side of the connector body.

6. The electrical connector of claim 1, wherein the plurality of slots is distributed on a front side and at least one of lateral sides of the connector body.

7. The electrical connector of claim 1, wherein the plurality of slots has a plurality of turning edges for allowing the bare wire ends to be bent over there so as to enable the bare wire ends to be accommodated in the slots.

8. The electrical connector of claim 7, wherein each of the turning edges is a substantially straight line.

9. The electrical connector of claim 7, wherein each of the turning edges has a U shape, a simple V shape, or a V shape realized by two non-straight curves.

10. The electrical connector of claim 1, wherein the connector body further comprises an outlet for allowing the electrical cable to run from the internal space to outside the connector body when the opening is closed by positioning the cover on the connector body, the outlet being sized such that the pre-defined cable width is 0.8 to 1 times of a cross-sectional width of the outlet.

11. The electrical connector of claim 1, wherein the connector body further comprises an outlet for allowing the electrical cable to run from the internal space to outside the connector body when the opening is closed by positioning the cover on the connector body, the outlet being partially surrounded by a U-shape plate protruded from the frame for supporting and guiding the electrical cable.

12. The electrical connector of claim 11, wherein the cover further comprises a closing plate arranged to work with the U-shape plate of the connector body in order to close the U-shaped plate, enabling the electrical cable to be fittingly accommodated therein when the electrical cable is connected with the electrical connector.

13. The electrical connector of claim 12, wherein the closing plate is formed and shaped as a rectangular slab.

14. The electrical connector of claim 12, wherein the closing plate is formed as an L-shaped solid.

15. The electrical connector of claim 1, wherein:

the connector body further comprises an outlet for allowing the electrical cable to run from the internal space to outside the connector body when the opening is closed by positioning the cover on the connector body; and the internal space has a length, measured in a direction perpendicular to a running direction of the electrical cable at the knotted cable end when the knot is positioned inside the internal space and the electrical cable runs through the outlet, of at least 3 times of the pre-defined cable width.

16. The electrical connector of claim 1, wherein:

the cover further includes a first hook and a second hook protruded from the first wing and the second wing, respectively, the first hook and the second hook being used together for locking the cover to the connector body when the cover is positioned onto the connector body; and the connector body further includes a first receptacle and a second receptacle located on a first lateral side of the connector body and a second lateral side opposite to the first lateral side, respectively, the first receptacle being used for receiving the first hook and locking thereto, the second receptacle being used for receiving the second hook and locking thereto.

17. The electrical connector of claim 1, wherein the first receptacle is in a form of a first groove recessed from the first lateral side, and the second receptacle is formed as a second groove recessed from the second lateral side.

18. The electrical connector of claim 1, wherein:

the connector body further comprises an outlet for allowing the electrical cable to run from the internal space to outside the connector body when the opening is closed by positioning the cover on the connector body; and the electrical connector further comprises a cable holder in a form of a hollow tube for holding the electrical cable therein, the cable holder being detachable from the connector body and being configured to fit into the outlet, thereby allowing the electrical cable to run from the internal space to outside the connector body through the cable holder.

* * * * *